United States Patent [19]

Caoduro

[11] Patent Number: 5,040,946

[45] Date of Patent: Aug. 20, 1991

[54] CASE, PARTICULARLY FOR CENTRIFUGAL RADIAL PUMPS, AND METHOD FOR MANUFACTURING THEREOF

[75] Inventor: Bruno Caoduro, Montecchio Maggiore, Italy

[73] Assignee: Ebara Corporation, Tokyo, Japan

[21] Appl. No.: 548,378

[22] Filed: Jul. 5, 1990

[30] Foreign Application Priority Data

Jul. 5, 1989 [IT] Italy ..... 85615 A/89

[51] Int. Cl.[5] ..... F01D 25/24

[52] U.S. Cl. ..... 415/182.1; 415/199.1; 415/206; 29/888.024; 29/888.025; 72/62; 72/336; 72/340; 72/379.4

[58] Field of Search ..... 415/198.1, 199.1, 199.2, 415/182.1, 202, 206, 58.4; 29/888.02, 888.024, 888.025; 72/62, 340, 379.4, 335, 336, 347

[56] References Cited

U.S. PATENT DOCUMENTS

| | | | |
|---|---|---|---|
| 2,372,917 | 4/1945 | Tuttle | 72/62 |
| 2,609,775 | 9/1952 | Gaudreau | 72/336 |
| 2,634,685 | 4/1953 | Buchi | 29/888.024 |
| 3,289,923 | 12/1966 | Millman | 415/206 |

FOREIGN PATENT DOCUMENTS

| | | | |
|---|---|---|---|
| 0024838 | 11/1967 | Japan | 72/62 |

*Primary Examiner*—John T. Kwon
*Assistant Examiner*—Christopher M. Verdier
*Attorney, Agent, or Firm*—Wolf, Greenfield & Sacks

[57] ABSTRACT

A case (1) for single- or multi-stage pumps having at least one centrifugal radial impeller, and a method for the manufacture of such case with metal plate. The case includes, for each stage and for each impeller, a substantially cylindrical lateral wall (2) and a device (15) for diffusing and directing the flow delivered from the impeller of each stage, which case has, in the lateral wall thereof, at least one volute with a uniformly increasing transverse cross section which is outwardly closed and is formed by an initial portion (17), an intermediate portion (18) and a final portion (19) which are mutually blended in a continuous manner. The initial and intermediate portions extend circumferentially to collect and diffuse the radial flow to the delivery port (4) of the impeller, whereas the end of the final portion is axially offset with respect to the initial and intermediate portions and is directed inwardly of the case to convey the flow toward a central region of the pressure chamber adjacent to the impeller.

10 Claims, 3 Drawing Sheets

FIG. 3
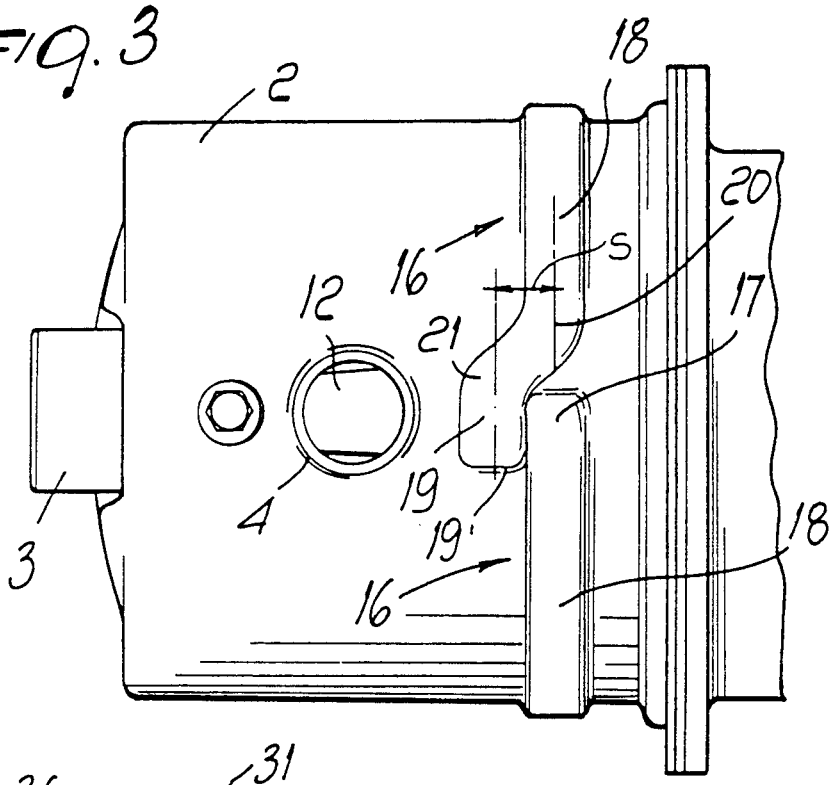
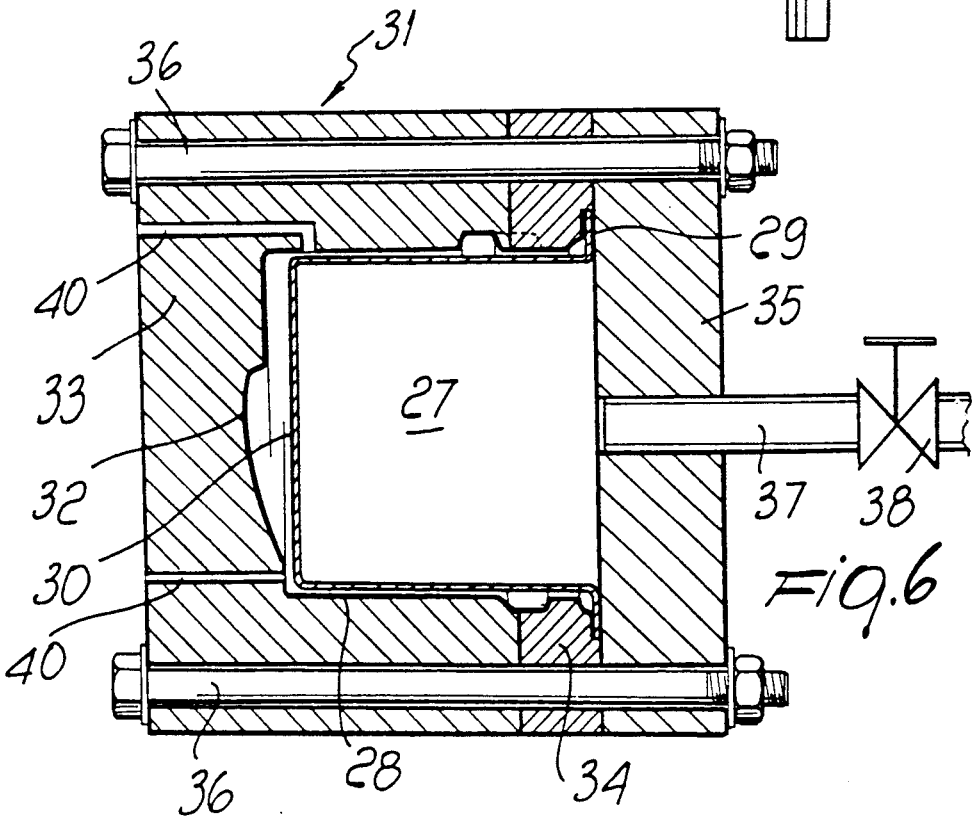
FIG. 6

CASE, PARTICULARLY FOR CENTRIFUGAL RADIAL PUMPS, AND METHOD FOR MANUFACTURING THEREOF

BACKGROUND OF THE INVENTION

1. Field of the Invention

The present invention relates to a case, particularly for single- or multi-stage pumps with centrifugal radial impeller, which comprises, for each stage and for each impeller, a device for diffusing and directing the flow delivered by the impeller. The invention furthermore relates to a method for the manufacture of said case with metal plate.

2. Description of the Prior Art

Italian patent Application No. 85605 A/89 filed on June 7, 1989 in the name of the same Applicant discloses a centrifugal pump incorporating an ejector, which ejector comprises a directing device with at least one approximately radial channel having an annular outlet section which extends peripherally to the diffusion duct of the ejector.

By means of said directing device, the flow delivered from the impeller is directed toward a central portion of the case adjacent to the outer wall of the diffusion duct, at such a distance from the discharge outlet to promote separation of the air and its conveyance toward the delivery port.

Though said known pump has the above described advantages, in a preferred embodiment it entails the use of a diffuser which, as is known, has the function of converting the kinetic energy imparted to the fluid by the impeller into pressure energy with the best possible efficiency.

As is known, diffusers are elements designed to operate in optimum operating conditions beyond which efficiency is lowered considerably.

It should be furthermore added that said elements have a relatively complex bladed structure requiring accurate design and rather onerous conventional machining which severely affects the overall cost of the pump.

SUMMARY OF THE INVENTION

The aim of the present invention is indeed to eliminate the disadvantages described above by providing a stator case with high efficiency and modest cost.

Within the scope of the above described aim, a particular object of the present invention is to provide a case incorporating a pressure diffusing and directing device which avoids the use of a conventional bladed diffuser.

A further object of the present invention is to provide a method for the manufacture of the above described case by means of short manufacturing times and completely automatic steps.

Another object of the invention is to provide a high-quality product at an economically competitive cost using simplified equipment and commonly commercially available materials.

This aim, these objects and others which will become apparent hereinafter are achieved by a stator case particularly for single- or multi-stage pumps with centrifugal radial impeller and built-in diffusion and conveyance device according to the preamble of the accompanying claim 1, characterized in that the diffusing and directing device comprises at least one volute with a uniformly increasing transverse cross section which is outwwardly closed, said volute defining an initial portion, an intermediate portion and a final portion which are mutually uniformly blended, wherein said initial and intermediate portions extend in an essentially circumferential direction to collect and diffuse the flow delivered peripherally of the impeller, said final portion being directed toward the inside of said case and being axially offset to direct the flow a central region of said case.

In a second aspect of the invention there is provided a method for the manufacture of the case with metal plate, according to the preamble of the accompanying claim 8, characterized in that the final step of formation is obtained by placing the partly-finished item inside an openable hollow die the internal walls of which reproduce the outer shape of the finished case, by closing the die so as to firmly constrain said semiworked item, occluding its open end, and by introducing a pressurized liquid into said die from the inner side of said partly-finished item to expand and deform it hydraulically against the inner walls of said die.

BRIEF DESCRIPTION OF THE DRAWINGS

Further characteristics and advantages of the invention will become apparent from the description of two preferred but not exclusive embodiments of the stator case according to the invention and of the related method for their manufacture, illustrated only by way of non-limitative example in the accompanying drawings, wherein:

FIG. 3 is an external side view of the stator case of FIGS. 1 and 2;

FIG. 6 is a sectional view of an apparatus for the manufacture of the outer casing of the stator case according to the invention starting from a semiworked item made of metal plate.

DESCRIPTION OF THE PREFERRED EMBODIMENTS OF THE INVENTION

Figure 1:
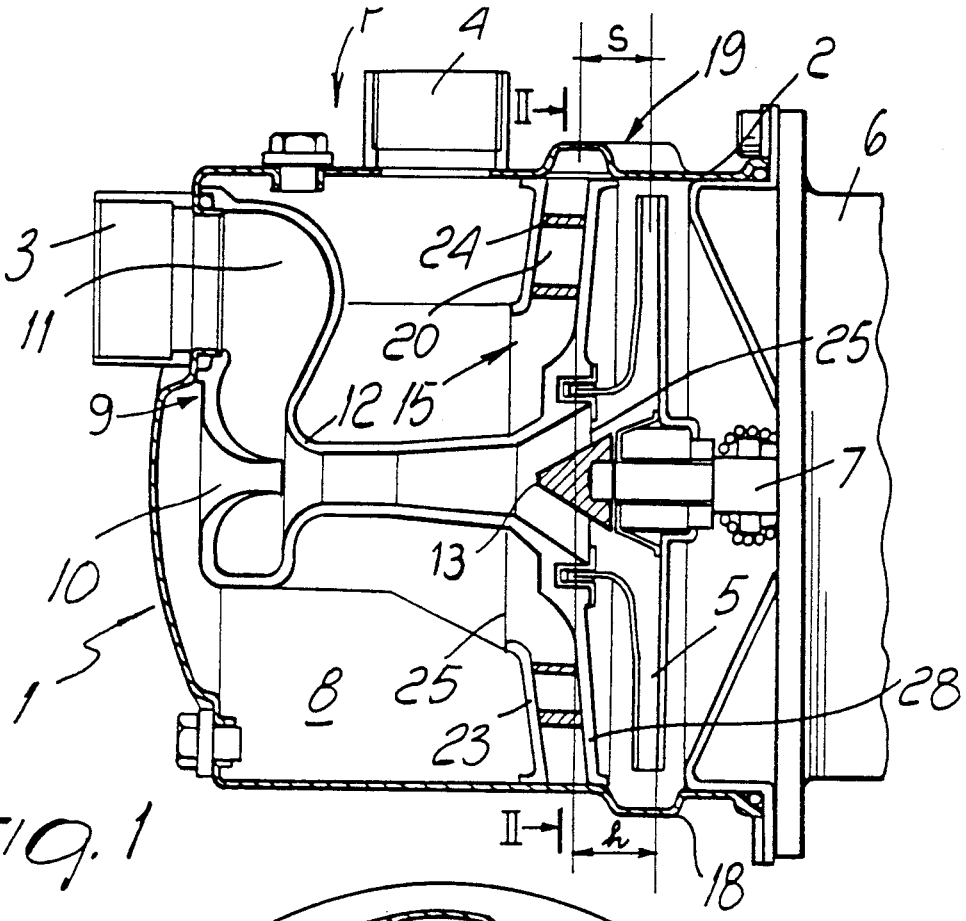
FIG. 1 is a partially sectional side view, taken along an axial plane, of a first embodiment of a stator case according to the invention, inserted in a single-stage centrifugal pump with built-in ejector.

With reference to the above figures, the case according to the invention, generally indicated by the reference numeral 1, is part of a centrifugal pump incorporating an ejector, generally indicated by the reference letter P.

The case 1 comprises an approximately cylindrical lateral wall 2 with an axial suction port 3 and a radial deliverly port 4. Inside the case there is an impeller 5 keyed on a shaft 7 driven by an electric motor 6.

In the pressure chamber 8 of the case 2 there is located an ejector, generally indicated by the reference numeral 9, which comprises a leading nozzle 10, an ejecting chamber 11 connected to the suction port 3 and a diffusion duct 12 connectd to the inflow section 13 of the impeller.

According to a main aspect of the invention, there is provided a device for directing the deliverly flow generated by the impeller 5, which is generally indicated by the reference numeral 15. In particular, the flow directing device comprises at least one, preferably a plurality of volute formations, generally indicated by the reference numeral 16, which are arranged peripherally of the impeller 5 and extend along the entire circumferential delivery path thereof.

In the illustrated embodiment there are provided three mutually independent volutes 16 each having an axis with approximately the shape of a logarithmic spiral and an increasing transverse cross section along the extension thereof. For the sake of clarity, each volute 16 defines an initial portion 17, an intermediate portion and a final portion 19 which are uniformly blended with each other.

In particular, the initial portion 17 and the intermediate portion 18 are aligned along a circular path, and have axes arranged on a perpendicular plane perpendicular to the symmetry axis of the case and appproximately coincident with the main plane of the impeller 5. The purpose of said portions 17 and 18 is to collect and diffuse the flow delivered by the peripheral region of the impeller.

The final portion 19 is initially aligned with the first two portions 17 and 18 and subsequently has an axial offset s with respect thereto, so as to produce a loop with a curved section 20 and with a oppositely-curved section 21. The value of the axial offset s is approximately equal to the total axial width h of the impeller 5 for reasons which will be exposed hereinafter.

The end of the portion 19 is closed by a wall 19' which is essentially perpendicular to the lateral wall 2 of the case and has the purpose of directing the flow toward the inside of the case in an approximately radial inward direction.

For descriptive completeness, inside the stator case 1 there is located an element with a plurality of through passages, the element being formed by a pair of transverse elements 23 substantially parallel to the peripheral portion ring of the impeller and defining therebetween an annular space, and by pairs of walls 24, which extend inside of said annular space, transversely to the walls 23, to define a plurality of approximately spiral-shaped directing passages directed toward the axis of the impeller. Said channels merge into a common annular outflow section 25 which extends peripherally to the diffusion duct 12 of the ejector 9.

Figure 2:
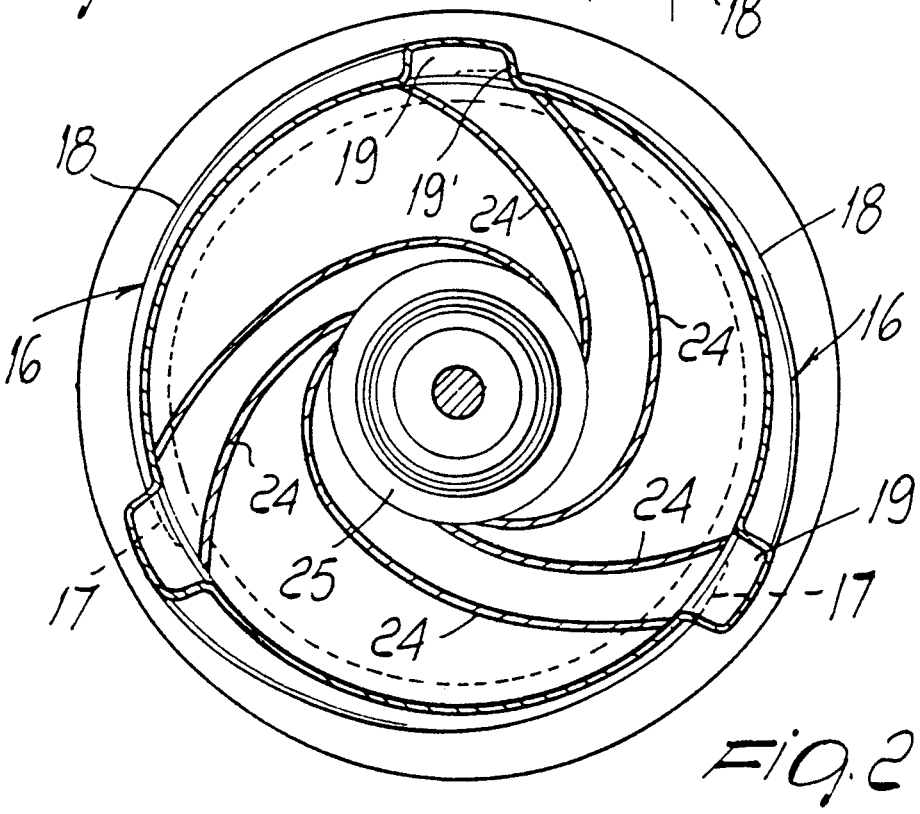
FIG. 2 is a sectional front view of the pump of FIG. 1, taken along the plane II—II.

As can be seen in FIG. 2, the external shape of the case 2 comprises the portions 20 and 21 mutually axially offset by the extend s with an end directed toward the inner region 8 of the case, which region is at a lower pressure and is adjacent to the suction ejector 9.

Figure 4:
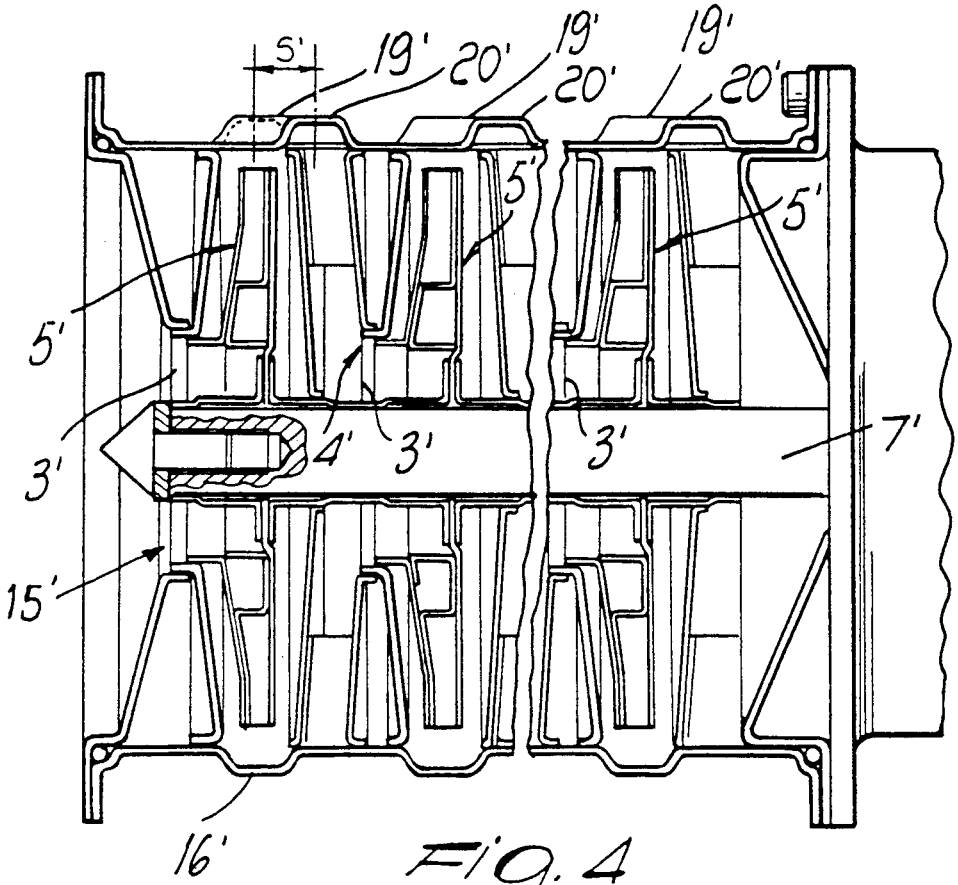
FIG. 4 is a partially sectional side view, taken along an axial plane, of a second embodiment of a stator case according to the invention, inserted in a multi-stage centrifugal pump.
Figure 5:
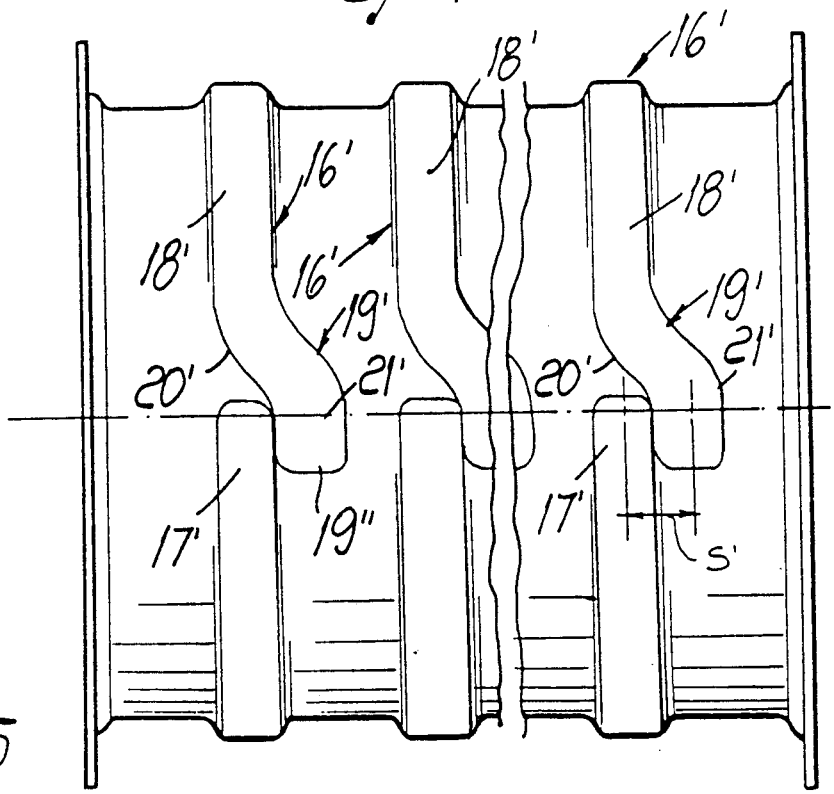
FIG. 5 is an external side view of the stator case of FIG. 4.

In the stator case embodiment schematically illustrated in FIGS. 4 and 5, the same reference numerals of the preceding figures have been used for the similar components, but said numerals have been referenced by one or more apexed marks.

In this second embodiment, which can be expressly used for multi-stage centrifugal pumps, in each stage the outlet section 4' is connected to the suction section 3' of the subsequent stage, with the interposition of a diffusion and re-directing device 15'.

In this embodiment, unlike the preceding one, the final portions 19' of the volutes 16' have an axial offset toward the region of the pump where the pressure rises, i.e. in the direction of the suction section of the subsequent stage.

Also in this case, the offset s' of the final portions 19' of the volutes 16' is such that the end of each terminal portion 19' is arranged at the side of the initial portion 17' of the subsequent volute.

In a further embodiment of the present invention which is not illustrated in the drawings and is suitable for a multi-stage pump with one or more pair of opposite impellers mounted on the same axis, the diffusing and directing device comprises a plurality of suitably shaped and dimensioned volutes falling within the scope of the same general inventive concept.

According to a further aspect of the invention, a process is provided for the manufacture of the stator case according to the invention with metal plate, preferably stainless steel or other similar material.

The process comprises a first step of blanking a metal plate disk and then of drawing of the blanked disk so as to obtain a hollow partly-finished item 27 with a substantially cylindrical lateral wall 28 which is open at one end, has an outer annular flange 29 and is closed at the opposite end by a substantially planar back wall 30.

In the subsequent step, the partly-finished item 27 is stamped so as to assume the external configuration of the finished casing.

FIG. 6 schematically illustrates an apparatus for the stamping of the above described unfinished item, generally indicated by the reference numeral 28.

The partly-finished item 27 is inserted into a cavity 32 of the fixture 31 formed by the segments 33, 34 and 35 which have an approximately cylindrical shape and can be mutually coaxially coupled. The inner walls of the end segment 33 and of the intermediate segment 34 define in negative the overall shape of the casing, whereas the end segment 35 defines the closure element of the fixture and has an annular step suitable for sealingly engaging the annular flange 29 of the partly-finished item 27.

The segments 33, 34 and 35 are aligned and mutually connected by strong blots 36 or by other similar securing elements. For descriptive completeness, it is noted that one or more vent holes 40 are provided in the walls of the die 31 to connect its inner cavity 32 with the open atmosphere, in order to allow the free expansion of the partially-finished item inside said cavity.

In the central region of the end segment 35 there is a tube 37 connected to inlet and outlet ducts, illustrated in the figure, with the interposition of a throttle valve schematically indicated at 38. The inlet and outlet ducts can be connected to a central unit for supply pressurized oil or another equivalent technical incompressible fluid in order to introduce and extract the working liquid and exert thereon very high hydrostatic pressures of up to 2000 atmospheres (approximately 201 Mpa). The force exerted by the pressurized liquid on the inner surfaces of the partly-finished item 27 forces them to deform plastically against the inner walls of the cavity 32 until they assume the final external configuration of the finished case.

The step of forming the semi-finished item 27 then provides the insertion of the item 27 into the cavity 32 of the fixture 31, the closure of the fixture by means of the blots 36 so as to provide the tight sealing of the inner wall of the item 27, the insertion of the working liquid into the die from the inner side of the semiworked item 27 as described above, the removal of the liquid from the expanded item, the opening of the die and the extraction of the formed part.

The part formed in the fixture 31 can subsequently be drilled and surface-finished so as to obtain the finished pump casing.

From the foregoing it can be seen that the process for manufacturing the case according to the invention achieves the cost requirements.

In particular, the use of a series of dies with automated opening and closing devices, associated with mechanized systems for automatically feeding and discharging the working liquid and for the automatic insertion and removal of the parts into and from the fixture, can achieve automatized manufacture of large series of items with considerably low production costs.

The case as well as the manufacturing method according to the invention are susceptible to numerous modifications and variations, all of which are within the scope of the inventive concept defined in the accompanying claims; all the details may furthermore be replaced with technically equivalent elements.

In pratice, the materials employed, so long as compatible with the specified use, as well as the dimensions and shapes, may be any according to the requirements and to the state of the art.

I claim:

1. Case, particularly for single- and multi-stage pumps with at least one centrifugal radial impeller, comprising, for each stage and for each impeller, a substantially cylindrical lateral wall and a device for diffusing and directing a delivery flow at an output of each stage, wherein said device comprises, in said lateral wall, at least one volute formation which has a uniformly increasing transverse cross section and which is outwardly closed, said volute defining an initial portion, an intermediate portion and a final portion which are mutually uniformly blended, said initial and intermediate portions extending in an essentially circumferential direction contained in a main plane of the impeller to collect and diffuse the flow delivered thereby, an end of said final portion having an axial offset with respect to said initial portion and said intermediate portion, and being directed toward an inside of said case so as to convey the flow toward a central region of said case adjacent to the impeller.

2. Stator, case, according to claim 1, wherein said axial offset of the final volute portion is approximately equal to an overall width of said impeller along an axis thereof.

3. Stator case, according to claim 1, wherein said diffusing and directing device is monolithically formed in said lateral wall and comprises at least two, preferably three, successive and independent volute formations disposed along the entire circumferential extension of said wall.

4. Stator case, according to claim 3, wherein the final portion of each volute comprises a first curved section and a second oppositely-curved section which define altogether a zigzag path determining said axial offset, an end of said second oppositely curved section being arranged side-by-side to the initial portion of a subsequent volute.

5. Stator case, according to claim 1, wherein it comprises a single stage with a multiple-volute diffusing and directing device, the final portions of said volutes being partially directed toward an inflow section of the impeller to convey the flow in a central portion of said case upstream of said inflow section of said impeller.

6. Stator case, according to claim 1, wherein it comprises a lateral wall defining a plurality of packed stages which are hydraulically series connected so that a delivery section of each stage is connected in series to a suction section of a successive stage with an interposition of said diffusing and directing device, the terminal portions of the volute formations of said device being directed axially toward the suction section of the subsequent stage.

7. Method for the manufacture of a stator case according to claim 1 with metal plate, comprising the steps of:

a) blanking of a circular disk of metal plate;

b) drawing of the blanked disk so as to obtain a concave semi-finished item with a substantially cylindrical lateral surface which is open at one end is closed at an opposite end by a substantially planar back surface;

c) final forming of the semi-finished item to simultaneously obtain formation of the lateral walls and of the diffusing and directing device in semi-finished conditions;

d) execution of necessary holes and passages;

e) surface finishing of the case;

said final forming step being obtained by placing the semi-finished item inside a hollow openable die which has an open end and internal walls reproducing an outer shape of the finished case, by closing the open end of said die to firmly retain said semi-finished item, and introducing a pressurized liquid into said die from an inner side of said semi-finished item to expand said item against the inner walls of said die.

8. Method according to claim 7, wherein said semi-finished item is so shaped to have, at the open end thereof, an annular flange which defines a retention surface suitable for interengagement with the inner walls of said die upon closure of the open end thereof.

9. Process according to claim 8, wherein said die comprises at least one first end portion, which defines a lateral surface of the finished product, and a second end portion which defines a removable back wall which is suitable for coupling longitudinally to said first end portion, said back wall having an engagement surface adapted to cooperate with said annular flange of said semi-finished item to close and retain said item during pressurization of said pressurized liquid.

10. Process according to claim 8, wherein said openable die is closed by removable securing means.

* * * * *